US005112374A

United States Patent [19]

Ackerman

[11] Patent Number: 5,112,374

[45] Date of Patent: May 12, 1992

[54] HAIR DRYER AIR FILTER

[76] Inventor: Timothy T. Ackerman, 14 Wilkenda Ave., East Haven, Conn. 06512

[21] Appl. No.: 651,201

[22] Filed: Feb. 6, 1991

[51] Int. Cl.[5] ..... B01D 50/00

[52] U.S. Cl. ..... 55/385.1; 55/361; 392/385; 34/82

[58] Field of Search ..... 34/82; 55/361, 363, 55/385.1; 392/329, 383-385

[56] References Cited

U.S. PATENT DOCUMENTS 983,986 2/1911 Dwyer ..... 55/363
1,750,446 3/1930 Wallace et al. ..... 55/363
2,041,687 5/1936 Benson ..... 392/385
3,610,251 10/1971 Sanderson ..... 392/385

FOREIGN PATENT DOCUMENTS 3443438 5/1986 Fed. Rep. of Germany ..... 34/82

*Primary Examiner*—Bernard Nozick

[57] ABSTRACT

An air filter for a hand held hair dryer employing a stretchable filter material which covers the air inlets of the hair dryer. A circular seal is fixed to one end of the filter material and stretches around the air outlet nozzle of the hair dryer. A second circular seal is fixed to the other end of the filter material at 90 degrees to the other seal and stretches around the handle of the hair dryer. The filter material conforms to the shape of the portion of the hair dryer it covers.

1 Claim, 1 Drawing Sheet

HAIR DRYER AIR FILTER

SUMMARY OF THE INVENTION

This invention is directed toward an air filter for a hand held hair dryer.

The air filter employs a stretchable filter material which covers the air inlets of the hair dryer. At one end of the filter is a circular seal which stretches and wraps around the air outlet nozzle of the hair dryer. At the other end of the air filter and at 90 degrees to the air outlet nozzle seal is another circular seal which stretches and wraps around the handle of the hair dryer.

The air outlet end of the hair dryer is inserted into one of the circular seals. The seal is stretched and pulled around the air inlet portion of the hair dryer and down around the handle of the hair dryer. The other seal is stretched and pulled over the air outlet nozzle of the hair dryer. The filter material stretches around the air inlets of the hair dryer and conforms to the shape of the portion of the hair dryer it covers.

The hair dryer air filter filters the air entering the air inlet of the hair dryer and keeps dirt and lint from lodging in the air inlet screens of the hair dryer. The air filter is easily cleaned and can be washed if necessary.

DETAILED DESCRIPTION OF THE INVENTION

Referring now to FIGS. 1-4.

Figure 1:
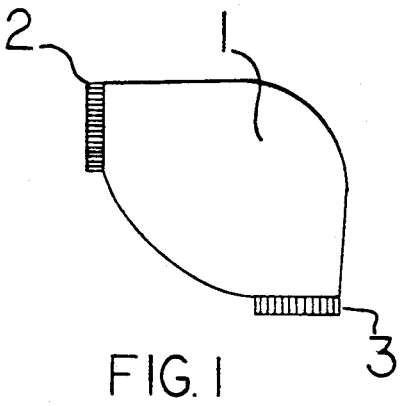
FIG. 1 is a side view of the invention showing the filter material in relation to the circular seals.
Figure 2:
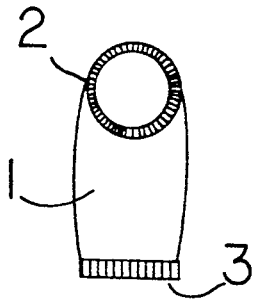
FIG. 2 is an end view of the invention showing the shape of one of the circular seals.
Figure 3:
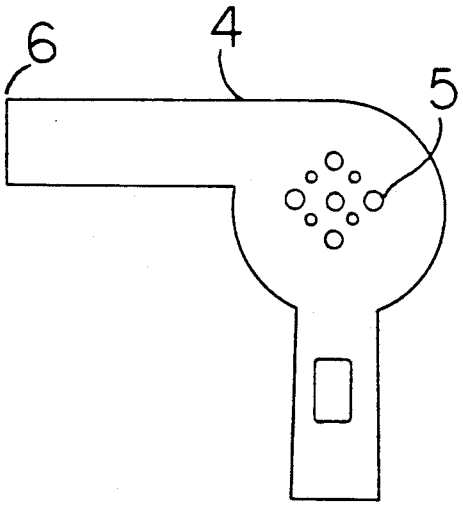
FIG. 3 is a view of the type of hand held hair dryer that the invention fits.

In FIG. 1 the invention is shown as being composed of the filter material 1 and circular seals 2 and 3. The filter material 1 is made of stretchable fabric that allows air to pass through it but filters out dirt and lint. The circular seals 2 and 3 are made of a stretchable material. The circular seals are of a one piece construction of a stretchable elastic type material which is directly attached to the filter material. The circular seals 2 and 3 are placed at a 90 degree angle to one another. The filter material 1 forms a tube with circular seals 2 and 3 located at each end as shown in FIG. 2. The filter material defines an enclosure and the circular seals define openings.

The type of hand held hair dryer 4 that the invention fits has air inlet holes 5 located on the sides of the hair dryer 4. The air inlet holes 5 clog up with dirt and lint after a period of use. The invention keeps the dirt and lint out of the air inlet holes 5.

The invention is placed on the hair dryer 4 in the following manner: circular seal 3 is stretched and pulled over outlet nozzle 6 of the hair dryer 4. The seal 3 is slid over the outlet nozzle 6 followed by the stretchable filter material 1. The seal 3 and stretchable filter material 1 is stretched and slid over the air inlet portion of the hair dryer 4 while then stretching seal 2 and sliding it over the outlet nozzle 6.

Figure 4:
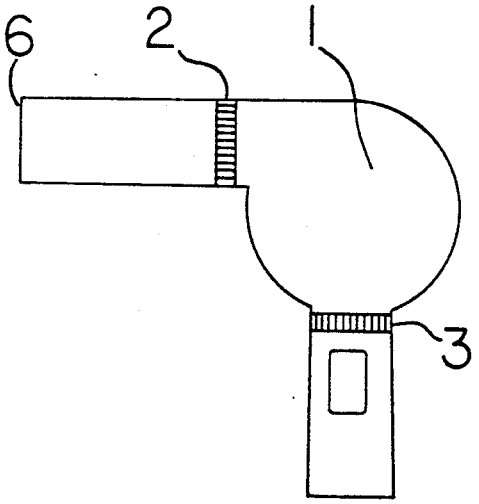
FIG. 4 is a view of the invention in place on a hand held hair dryer.

In FIG. 4 seal 3 remains in position at the top of the handle portion of the hair 4 and keeps dirt from entering between the filter material and the handle. The filter material 1 remains in position covering the air inlet portion of the hair dryer and conforms to the shape of the portion of the hair dryer that it covers. Seal 2 remains in position around the air outlet nozzle 6 and keeps dirt from entering between the filter material 1 and the outlet nozzle 6.

When the hair dryer is turned on and air is drawn in through the air inlet holes 5 the filter material 1 keeps lint and dirt from entering the air inlet holes 5. The dirt and lint may be easily brushed away or the filter may be removed and washed or replaced.

While I have described my invention with particular reference to the drawings, such is not to be considered as limiting its actual scope.

Having thus described this invention, what is asserted as new is:

1. A filter for a hand held hair dryer having air inlets comprising:

a stretchable filter material which covers the air inlets of the hair dryer and forms the shape of the portion of the hair dryer it covers;

a circular seal at one end of the filter material which stretches and is positioned around the upper portion of the handle of the hair dryer and keeps dirt from entering between the filter material and the handle and a second circular seal at a 90 degree angle to the other seal and which stretches and is positioned around the air outlet nozzle of the hair dryer for the purpose of keeping dirt from entering between the air outlet nozzle and the filter material wherein the filter material defines an enclosure and the circular seals define openings.

* * * * *